US005936529A

United States Patent [19]

Reisman et al.

[11] Patent Number: 5,936,529

[45] Date of Patent: Aug. 10, 1999

[54] ELECTRONIC MONITORING SYSTEM

[75] Inventors: Yoav Reisman, Ra$^3$anana; Guy Greitser, Haifa; Gil Gemer, Nirit; Tzahi Itzhak Pilli, Tel Aviv, all of Israel

[73] Assignee: Elmo-Tech Ltd., Herzliya, Israel

[21] Appl. No.: 08/899,610

[22] Filed: Jul. 24, 1997

[51] Int. Cl.$^6$ ..... G08B 23/00

[52] U.S. Cl. ..... 340/573.1; 340/573.4; 340/539; 340/825.54; 340/825.49

[58] Field of Search ..... 340/573, 572, 340/539, 571, 825.54, 825.49, 825.44; 379/38

[56] References Cited

U.S. PATENT DOCUMENTS

| | | | |
|---|---|---|---|
| 3,972,320 | 8/1976 | Kalman | 340/573 |
| 4,598,272 | 7/1986 | Cox | 340/573 |
| 4,736,196 | 4/1988 | McMahon et al. | 340/573 |
| 4,812,823 | 3/1989 | Dickerson | 340/573 |
| 4,937,581 | 6/1990 | Baldwin et al. | 340/825.54 |
| 5,054,569 | 10/1991 | Scott et al. | 340/502 |
| 5,075,670 | 12/1991 | Bower et al. | 340/573 |
| 5,117,222 | 5/1992 | McCurdy et al. | 340/573 |
| 5,189,395 | 2/1993 | Mitchell | 340/539 |
| 5,204,670 | 4/1993 | Stinton | 340/573 |
| 5,266,944 | 11/1993 | Carroll et al. | 340/573 |
| 5,298,884 | 3/1994 | Gilmore et al. | 340/573 |
| 5,471,197 | 11/1995 | McCurdy et al. | 340/573 |
| 5,504,474 | 4/1996 | Libman et al. | 340/572 |
| 5,621,384 | 4/1997 | Crimmins et al. | 340/539 |
| 5,627,520 | 5/1997 | Grubbs et al. | 340/572 |

*Primary Examiner*—Nina Tong
*Attorney, Agent, or Firm*—Foley & Lardner

[57] ABSTRACT

An electronic monitoring system includes an electronic monitoring device having straps for attaching the device to a limb of a subject for monitoring, at a remote location, movements and/or other activities of the subject; a closure member to be applied to the ends of the straps to secure them together according to the size of the subject's limb to be enclosed; and a manual resetting device having electrical terminals adapted to be brought into electrical communication with electrical terminals on the strap ends when the closure member is removed for resetting the electronic monitoring device.

16 Claims, 4 Drawing Sheets

INITIALIZATION
40
BUTTON DEPRESSED?
N
Y
41
TRANSMIT
1. OPERATION OF BUTTON
2. ID OF MRD
42
START TIMER
43
TIME RUN-OUT?
Y
N
45
BLINK "NACK" TO USER
44
MESSAGE RECEIVED FROM EMD?
Y
N
46
ACK OR NACK?
NACK
ACK
47
STORE IN MRD
1. ID OF EMD
2. "NACK"
3. PROG. NO.
48
BLINK "ACK" TO USER
49
STORE IN MRD
1. ID OF EMD
2. "ACK"
3. PROG. NO.

ELECTRONIC MONITORING SYSTEM

FIELD AND BACKGROUND OF THE INVENTION

The present invention relates to electronic monitoring devices, and particularly to such devices to be attached to a person for monitoring the movements or other activities of the person. The invention also relates to an electronic monitoring system including such devices.

As pointed out in U.S. Pat. No. 5,504,474, incorporated herein by reference and assigned to the same assignee as the present application, the increasing overcrowding of jails and houses of detention has increased the popularity to sentence certain types of offenders, particularly non-violent ones, to confinement within a pre-designated location, such as the offender's place of residence, the residence of a responsible relative, or the location of certain rehabilitating institutions. For this purpose, a number of electronic monitoring devices have been developed to be attached to a person for monitoring the movements or other activities of the person. Such electronic monitoring devices typically include a tamper sensor for sensing tampering with the device or removal of the device from the person to whom the device was attached, and for producing a corresponding tamper signal which is processed by a data processor and which is fed, with an identification signal identifying the respective device, to a transmitter for transmission to an external receiver. The external receiver may be a stationary one or a mobile one. Frequently, the receiver is a local one located in the immediate area of the confinement and transmits its information to a central station which monitors the activities of many persons having electronic monitoring devices attached to them.

The above-cited U.S. Pat. No. 5,504,474 cites a large number of prior patents, which are also hereby incorporated by reference, relating to electronic monitoring devices and electronic monitoring systems of the foregoing type.

Such electronic monitoring devices are quite expensive, and it would therefore be desirable to construct them for reuse. However, different subjects may require different monitoring programs, e.g., regarding the sampling intervals, the data transmission intervals, the monitored time periods, the locations barred or permitted to the subject, etc. One system now in use programs each monitoring device according to a specific program, and uses the monitoring device only on subjects to be monitored according to the respective program.

OBJECT AND BRIEF SUBJECT OF THE INVENTION

An object of the present invention is to provide an electronic monitoring system including an electronic monitoring device of the foregoing type to be applied to the subject, and a resetting device which enables the monitoring device to be reset in a quick and simple manner, by reprogramming it for use with a different subject, or by disabling it for conserving battery power when the device is returned to inventory for future use.

According to a broad aspect of the present invention, there is provided an electronic monitoring system, comprising: an electronic monitoring device including a housing attachable to a subject for monitoring, at a remote location, movements and/or other activities of the subject; a closure member to secure the housing to the subject; and electronic circuitry including a data processor and a transmitter within the housing for receiving, processing, and transmitting to the remote location data regarding the activities of the subject; the data processor including a memory for storing the identification of the electronic monitoring device and the operational program of its data processor; and a manual resetting device having electrical terminals adapted to be brought into communication with electrical terminals on the electronic monitoring device when the closure member is removed therefrom, for resetting the electronic monitoring device.

According to still further features in the described preferred embodiment, the manual resetting device further includes a data processor storing a program to be downloaded into the memory of the data processor in the electronic monitoring device; an "Enable" key for enabling the electronic monitoring device and for downloading the program thereto; and a "Disable" key for disabling the electronic monitoring device.

According to further features in the described preferred embodiment, the manual resetting device includes an indicator controlled by its data processor to indicate whether the electronic monitoring device has been successfully reset.

According to additional features included in the described preferred embodiment, each manual resetting device further includes a unique identification number stored therein; and the data processor of the manual resetting device is programmed to download the identification into the memory of the data processor in the electronic monitoring device when resetting the electronic monitoring device. In addition, the data processor of the manual resetting device is programmed, when downloading a program into the memory of the data processor in the electronic monitoring device, also to command the electronic monitoring device to store and periodically transmit the identification of the manual resetting device with the other data transmitted by the electronic monitoring device to the remote location. The data processor of the manual resetting device is programmed, when downloading a program into the memory of the data processor in the electronic monitoring device, also to receive and to store the identification of each electronic monitoring device reset thereby, and also the program downloaded thereto.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
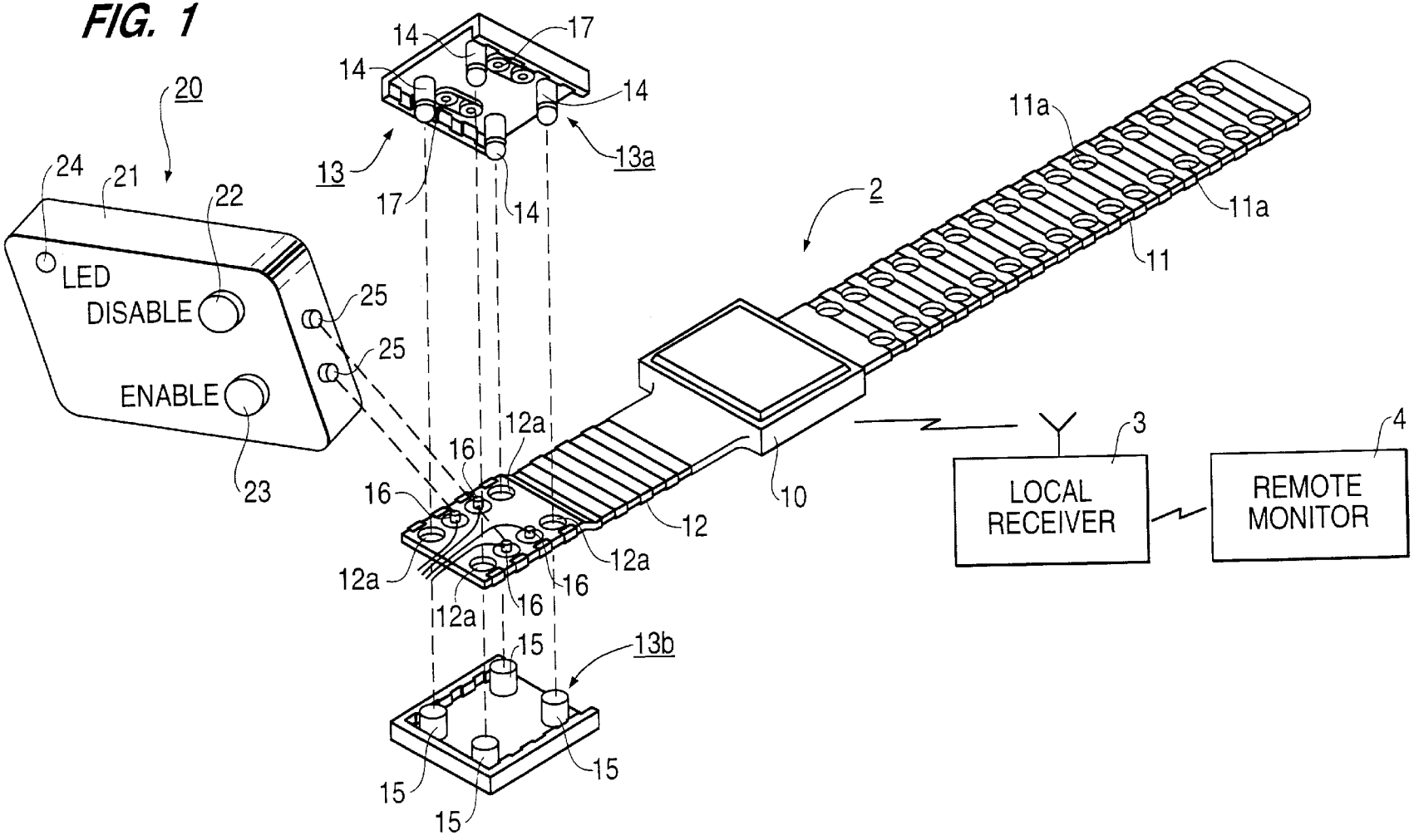
FIG. 1 illustrates one form of electronic monitoring system constructed in accordance with the present invention.

FIG. 1 illustrates an electronic monitoring device, generally designated 2, to be attached to a person for monitoring movements and other activities of the person. These activities as detected by monitoring device 2 are transmitted to a local receiver 3 located in the general area of the person being monitored, such as the person's home residence. The information received by the local receiver 3 is in turn transmitted to a remote monitor 4 which monitors the activities of a number of persons each equipped with a personal monitoring device 2. The transmission from the monitoring device 2 to the local receiver 3 is by wireless transmission; and the transmission from local receiver 3 to the remote monitor 4 may be by wireless transmission or by wires, e.g., via the regular telephone or a cellular telephone.

Electronic monitoring device 2 includes a housing 10 for housing the electronic circuitry, and a pair of straps 11, 12 defining a band for attaching the housing to a limb preferably the ankle or wrist of the person to be monitored. To enable the monitoring device to be used with different size persons, both straps 11 and 12 are provided with a plurality of pairs of holes 11*a*, 12*a* along their lengths, cooperable with a closure member 13 for fixing the effective lengths of the two straps according to the size of the person's ankle or wrist. Closure member 13 includes two parts 13*a*, 13*b* to be disposed on the opposite sides of the overlapping ends of the two straps 11, 12 after the monitoring device has been applied to the person. Part 13*a* includes four pins 14, and part 13*b* includes four complementary sockets 15, such that after the ends of the two straps 11, 12 have been applied around the person's ankle (or wrist), pins 14 of part 13*a* may be passed through the appropriate aligned holes 11*a*, 12*a*, of the overlapping ends of the two straps 11, 12, and force-fitted into their respective sockets 15 of part 13*b*, to fix the monitoring device to the person's ankle (or wrist).

The illustrated monitoring device 2 further includes a tamper sensor for sensing any tampering with the monitoring devices or its removal from the person to whom it was attached. The tamper sensor in the illustrated monitoring device may be the same as described in the above-cited U.S. Pat. No. 5,504,474. Such a sensor includes electrical conductors (not shown) extending through the two straps 11, 12, electrical terminals 16 provided in the end of strap 12, and electrical pads 17 formed in part 13*a* engageable by terminals 16 when the two parts 13*a*, 13*b* of the closure member 13 are fixed as required to the overlapping ends of the two straps. The arrangement is that any cutting of strap 11 or 12, or any attempt to separate the two parts 13*a*, 13*b* from the straps, will result in a break in the continuity of the electrical circuit which would be sensed by the electrical circuitry within housing 10.

Further details of the construction of the tamper sensor, the straps 11, 12, and of the two-part closure member 13, are set forth in the above-cited U.S. Pat. No. 5,504,474, whose contents are incorporated by reference.

As indicated earlier, if the electronic monitoring device is to be reused with another subject, it must be re-programmed. This is permitted, in the system illustrated in FIG. 1, by the provision of a manual resetting device, generally designated 20. As will be described more particularly below, manual resetting device 20 may be used for both disabling the electronic monitoring device 2 so that the device can be placed back into inventory for future use without draining the battery, or for reprogramming the device for use by another subject, which reprogram may be the same as the previous one or a different one. In addition, to provide protection against an unauthorized resetting of an electronic monitoring devices the manual resetting device 20, when used for resetting the electronic circuitry within housing 10 of the monitoring device, also downloads the identification number of the manual resetting device into the memory of the monitoring device and commands the monitoring device to periodically transmit the identification of the resetting device with the data transferred to the remote location.

Thus, such a manual resetting device not only simplifies resetting a monitoring device, but also assures that the resetting device will always be identified so that an unauthorized resetting of the monitoring device will be quickly detected.

The manual resetting device is shown at 20 in FIG. 1. Its electrical circuitry, as well as the electrical circuitry of the electronic monitoring device 2, is shown in FIG. 2.

Thus, the manual resetting device 20 is enclosed within a housing 21 which may be constructed for easy portability. It includes two depressible keys: Disable key 22, and Enable key 23. It also includes an LED visual indicator 24. It further includes two terminals 25, which are connectible, e.g., either by direct contact or by induction, with two of the terminals 16 on strap 12 in order to communicate with the electronic circuitry within housing 10 of the monitoring device 2 after the closure member 13 has been removed.

Figure 2:
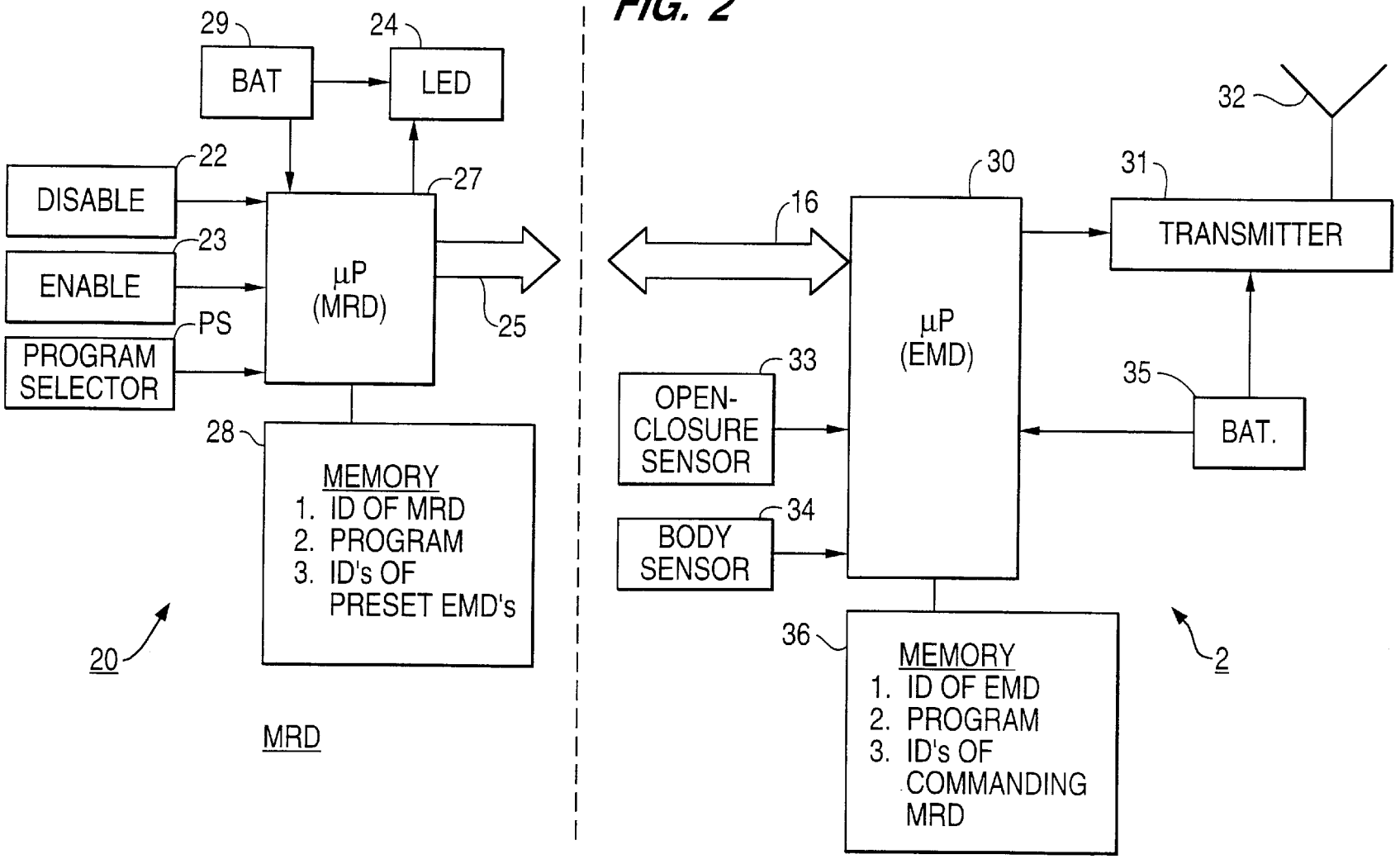
FIG. 2 is a block diagram illustrating the main electrical components in the electronic monitoring device and manual resetting device in the system of FIG. 1.

As shown in FIG. 2, manual resetting device 20 further includes a microprocessor 27 having a memory 28 storing the program to be downloaded into the electronic monitoring device 2, and also storing the identification number of the manual resetting device. This identification number is also downloaded and stored in the electronic monitoring device 2 when reset.

Preferably, memory 28 in the manual resetting device 20 stores a number of programs which may be preselected for use when reprogramming another electronic monitoring device 2. For the sake of convenience, the selection of any particular program of those stored is made at the factory by a program selector switch PS within housing 21; but it will be appreciated that the resetting device could include a selector switch externally of the housing to enable the user to preselect the desired program.

Memory 28 further includes a section for storing the identifications of all the electronic memory devices it presets, so that it can provide this information, including the programs applied in each case, whenever desired to an external data processor, e.g., for record purposes. This information stored within the manual resetting device 20 may be read out of the resetting device in any suitable manner, e.g., by electrical contacts, induction, RF transmission, or by removal of the storage element.

Microprocessor 27 and LED 24 of the manual resetting device are powered by a battery 29.

FIG. 2 also shows the electronic circuitry within housing 10 of the electronic monitoring device 2. This circuitry includes a microprocessor 30 adapted to communicate, via terminals 16 and 25, with the manual resetting device 20, and a transmitter 31 connected to microprocessor 30 for transmitting the data processed therein to the remote location via antenna 32. Microprocessor 30 further includes other inputs, e.g., an input from the open-closure sensor 33 and the body (proximity) sensor 34, for example as described in the above-cited U.S. Pat. No. 5,504,474 for processing the received information concerning the movements or other activities of the subject to which the monitoring device is attached, and for transmitting this information to the remote location via transmitter 31 and antenna 32. The microprocessor 30 and transmitter 31 are powered by a battery 35 contained within the monitoring device.

Data processor 30 of the monitoring device 2 further includes a memory 36 for storing the program downloaded from the manual resetting device 20, its identification, and also the identification of the manual resetting devices used for resetting it. The latter identification is transmitted with the other data to the remote location not only to inform of authorized resettings, but also to assure that any unauthorized resetting or reprogramming of the monitoring device, or attempt with respect thereto will not go undetected.

When using the manual resetting device 20 to reset the monitoring device 2, part 13*a* of the closure member 13 may be removed in order to provide access to terminals 16 in strap 12 of the monitoring device 2. The manual resetting device 20 is held with its terminals 25 in contact with terminals 16 of the monitoring device, or in induction proximity with terminal 16 (e.g., without removing part 13*a* of the closure member). If the monitoring device is to be disabled, Disable key 22 is depressed; and if the monitoring device is to be enabled, Enable key 23 is depressed to download the enabling program of the manual resetting device into the monitoring device. The LED 24 is energized with an acknowledging "ACK" signal (e.g., producing slow blinks) when the manual resetting has been successfully completed, and with a not-acknowledging "NACK" signal (e.g., producing rapid blinks) when the manual resetting has not been successfully completed.

After the monitoring device 2 has been successfully reset, a new closure member part 13*a* is attached to part 13*b* and the overlapping ends of the straps 11, 12, or both new closure parts 13*a*, 13*b* may be attached to the overlapping ends of the straps, to fix these ends according to the size of the wrist or ankle of the subject to which the monitoring device is to be attached, and also to establish the necessary continuity between pins 16 of strap 12 and pads 17 of closure member part 13*a*.

Figure 3:
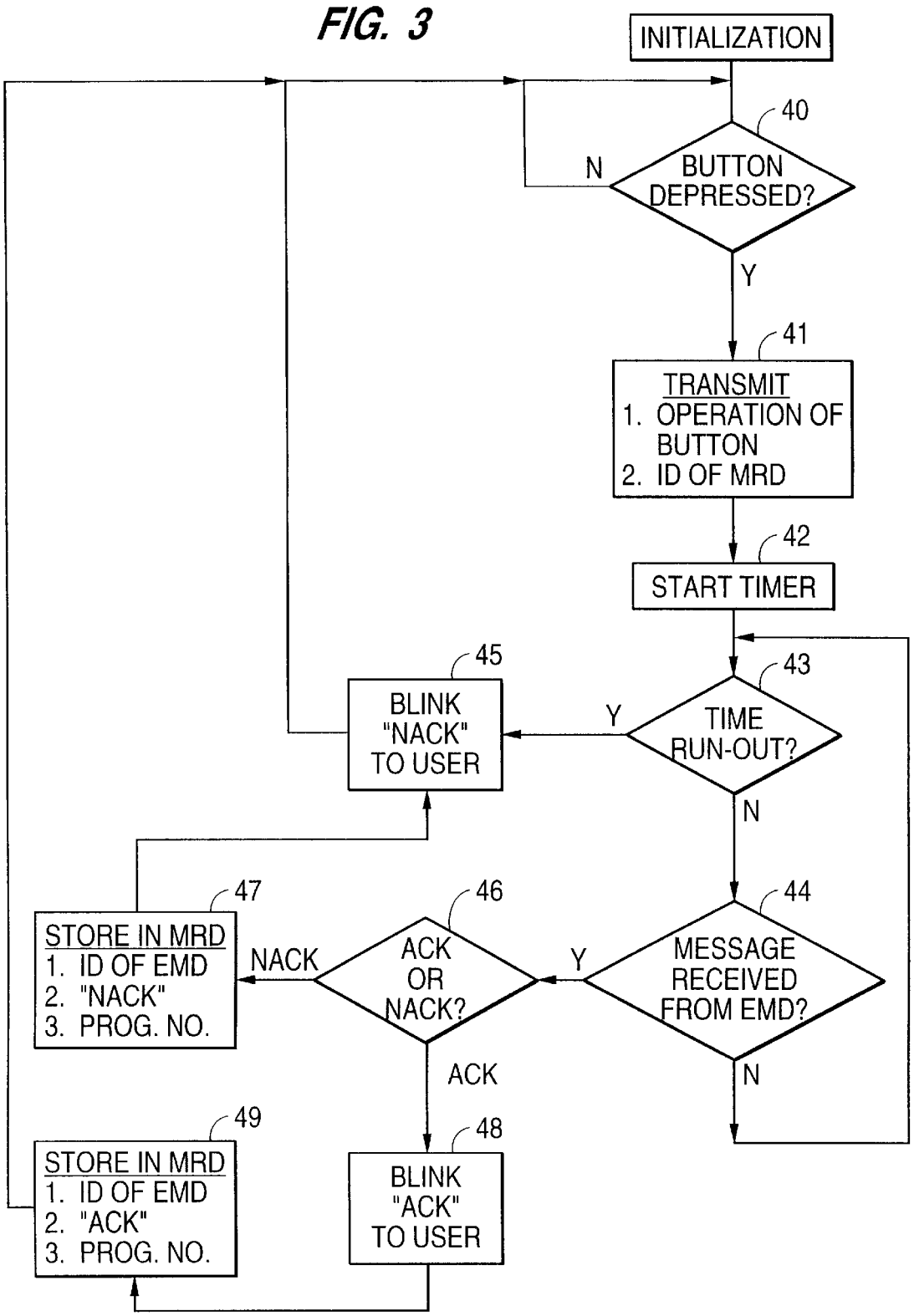
FIG. 3 is a flowchart illustrating one example of operation of the manual resetting device in the system illustrated in the drawings.
Figure 4:
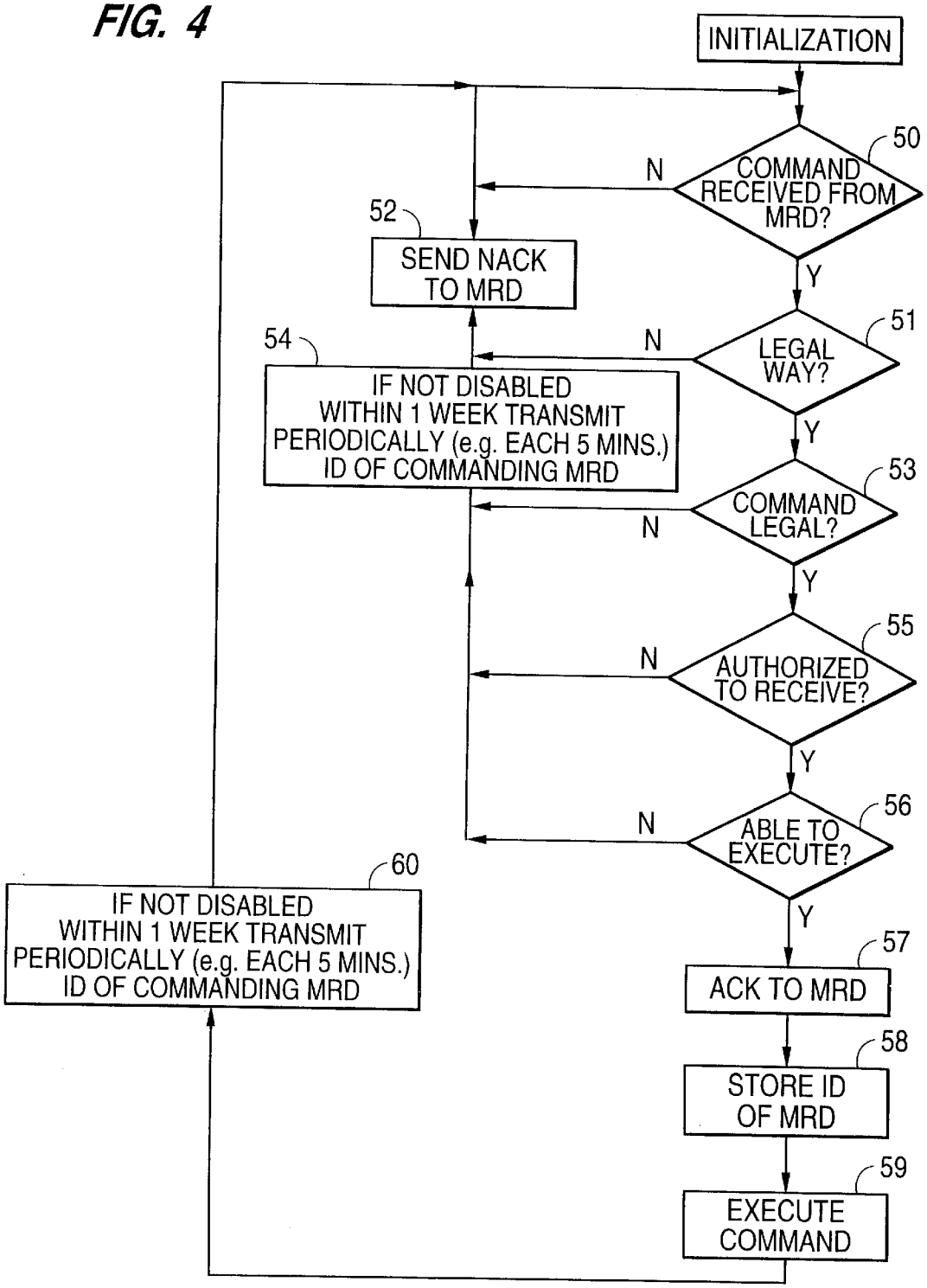
FIG. 4 is a flowchart illustrating one example of operation of the electronic monitoring device in the system illustrated in the drawings.

FIG. 3 is a flowchart illustrating an example of the operational program of microprocessor 27 in the manual resetting device 20; and FIG. 4 is a flowchart illustrating an example of the operational program of microprocessor 30 in the electronic monitoring device 2.

With respect to the flowchart in FIG. 3 illustrating the operation of the microprocessor in the manual resetting device 20, the microprocessor first checks to see whether a button is depressed (block 40), and if so, it transmits to the electronic monitoring device 2 the operation specified by the push button (i.e., "Disable" or "Enable") and also the identification of the respective manual resetting device (block 41). A timer within microprocessor 27 is then started (block 42), e.g., to time three seconds, and a check is made to determine whether a message is received from the electronic monitoring device within that time period (blocks 43, 44); if not, the LED 24 is blinked (e.g., rapidly), or continuously energized to indicate "NACK" (block 45). If a message is received from the electronic monitoring device 2, however, a check is made to determine whether the message is "ACK" or "NACK" (block 46). If "NACK", there is stored in the memory 28 of the manual resetting device the identification of the electronic monitoring device, the "NACK" signal, and the program number (block 47), and then blink "NACK" to the user (block 45). If the message received from the electronic monitoring device is "ACK", LED 24 is blinked (e.g., slowly) to indicate "ACK", and there is stored in the memory of the manual resetting device the identification of the electronic monitoring device, the signal "ACK", and the program number used in resetting electronic monitoring device.

With respect to the flowchart of FIG. 4 illustrating the operation of microprocessor 30 in the electronic monitoring device, it will be seen that it first waits until a command is received from the manual resetting device (block 50), and then makes a communication check to determine that the command was received in a legal way (block 51). Such a communication check may be any of the known ones, such as the Cyclic Redundancy Check (CRC). If this check indicates the command was not properly received, a "NACK" signal is sent to the manual resetting device 20 (block 52).

A legality check is then made (block 53) to determine whether that electronic monitoring device is allowed to communicate with the specific manual resetting device; for example, if the manual resetting device is on a "Stolen list", the result of this check would be negative. If such a check is found to be negative, the electronic monitoring device transmits to the local receiver (3, FIG. 1), sometime within the coming week, a report informing the local receiver periodically (e.g., every five minutes) the identification of the commanding manual resetting device (block 54), and also sends a "NACK" signal to the manual resetting device (block 52).

An "Authorization" check is then made (block 55), followed by an "Ability to Perform" check (block 56). If either of these checks is negative, this information is included in the report (block 54) sent to the local receiver, and also acts to send a "NACK" signal to the manual resetting device.

The "Authorization" check performed in block 55 is made to assure that the specific electronic monitoring device is authorized to receive a command from the specific manual resetting device; for example, some electronic monitoring devices are authorized to receive only certain commands from supervisors. The "Ability to Perform" check (block 56) is made to assure that the electronic monitoring device is capable of executing the command; for example, if its battery is too low, it would produce a negative result when this check is made.

Assuming all the preceding checks are successful, the electronic monitoring device then transmits an "ACK" signal to the data processor 27 of the manual resetting device 20 (block 57), stores the identification of the manual resetting device (block 58), and executes the command (block 59). Thereafter, within one week, it periodically (e.g., each five minutes) transmits to the local receiver 3 the identification of the commanding manual resetting device if not disabled.

Thus, the remote location will be continuously advised of the identification of the manual resetting device that last reset the monitoring device, so that in case the manual resetting device was not an authorized one, this will be quickly detected.

While the invention has been described with respect to one preferred embodiment, it will be appreciated that this is set forth merely for purposes of example, and that many variations and other applications of the invention may be made. For example, the resetting can be effected in other manners, e.g., by induction without opening the closure member. Further, while the indicator 24 is a visual one it could be an audio one. In addition, the monitoring device may be used for monitoring movements other than those under house arrest, e.g., movements of medical patients, children in shopping centers, animals, etc. Also, the monitoring device could supply other information (in addition to the ID, ACK and NACK) to the resetting device, e.g. past failed attempts to reset, and other information to the remote location, e.g. identifications of the manual resetting devices which issued the last "Disabling", and/or "Enabling" commands, a list of the received commands, etc. Further, the monitoring device could be applied to parts of a subject other than the limbs, e.g. around the neck or attached to subject's clothing. Many other variations, modifications and applications of the invention will be apparent.

What is claimed is:

1. An electronic monitoring system for monitoring at a remote location a subject's movements and/or other activities, the electronic monitoring system comprising:

an electronic monitoring device including:

a housing adapted for being attached to the subject;

a closure member securing the housing to the subject; and electronic circuitry being supported within the housing and including a first data processor adapted for receiving and processing data and a transmitter adapted for transmitting data to a receiver at the remote location regarding the movements and/or activities of the subject;

said first data processor including a memory for storing an identification of the electronic monitoring device and a program for operating the first data processor; and a manual resetting device for resetting the electronic monitoring device, the manual resetting device having first electrical terminals adapted for communicating with second electrical terminals on the electronic monitoring device when the closure member is removed with respect to the electronic monitoring device, and the manual resetting device further having an identification number stored therein;

wherein said data processor of the manual resetting device is programmed to download said identification number into the memory of the data processor in the electronic monitoring device when resetting the electronic monitoring device.

2. The electronic monitoring system according to claim 1, wherein said manual resetting device includes a second data processor and an indicator controlled by said second data processor indicating whether the electronic monitoring device has been successfully reset.

3. The electronic monitoring system according to claim 1, wherein said manual resetting device further includes:

a second data processor storing a program to be downloaded into the memory of the first data processor;

an "Enable" key adapted for enabling the electronic monitoring device and adapted for downloading said program to the electronic monitoring device; and a "Disable" key adapted for disabling the electronic monitoring device.

4. The electronic monitoring system according to claim 1, wherein said second data processor is programmed, when downloading the program into the memory of the first data processor, also to command the electronic monitoring device to store and periodically transmit the identification number with the data transmitted by the electronic monitoring device to the receiver at said remote location.

5. The electronic monitoring system according to claim 4, wherein said second data processor is also programmed, when downloading the program into the memory of the first data processor, also to receive and to store the identification of the electronic monitoring device being reset and the program being downloaded to the electronic monitoring device.

6. The electronic monitoring system according to claim 1, wherein said electronic monitoring device includes a pair of straps adapted for attaching the housing to a limb of the subject, said closure member including two parts on opposite sides of the straps securing together ends of the straps according to the subject's limb size; one of said closure member parts electrically connecting said second electrical terminals when the closure member is applied to the ends of the straps.

7. An electronic monitoring system for monitoring at a remote location a subject's movements and/or other activities, the electronic monitoring system comprising:

an electronic monitoring device including:

a housing;

straps adapted for attaching the housing to the subject;

a closure member securing ends of the straps together according to the subject's size; said closure member including two parts disposed on opposite sides of the strap ends and being secured together with the strap ends interposed between the two closure member parts;

electronic circuitry being supported within the housing and including a first data processor adapted for receiving and processing data and a transmitter adapted for transmitting data to a receiver at the remote location regarding the movements and/or activities of the subject;

said first data processor including a memory for storing an identifier of the electronic monitoring device and a program for operating the first data processor;

one of the closure member parts and one of the strap ends including electrical terminals adapted for establishing an electrical circuit when the closure member is applied to the one strap end, the electrical circuit being connected to said first data processor for enabling the electronic monitoring device to detect an absence of said closure member; and a manual resetting device including electrical terminals adapted for electrical communication with the electrical terminals on the one strap end when resetting the electronic monitoring device, said manual resetting device further including:

a second data processor storing the program in the memory of the first data processor;

an "Enable" key adapted for enabling the electronic monitoring device and adapted for downloading the program to the electronic monitoring device; and a "Disable" key adapted for disabling the electronic monitoring device.

8. The electronic monitoring system according to claim 7, wherein said manual resetting device further includes an indicator, and wherein said second data processor is programmed to control said indicator to indicate whether the electronic monitoring device has been successfully reset.

9. The electronic monitoring system according to claim 7, wherein said manual resetting device further includes an identification number stored therein, and wherein said second data processor is programmed to download said identification number into the memory of the first data processor when resetting the electronic monitoring device.

10. The electronic monitoring system according to claim 9, wherein said second data processor is programmed to download the program into the memory of the first data processor and to command the electronic monitoring device to periodically transmit the identification number and other data to the receiver at said remote location.

11. The electronic monitoring system according to claim 10, wherein said second data processor is programmed to download the program into the memory of the first data processor and to store the identification of the electronic monitoring device and the program being downloaded to the electronic monitoring device.

12. An electronic monitoring system for monitoring at a remote location a subject's movements and/or other activities, the electronic monitoring system comprising:

an electronic monitoring device adapted for being attached to the subject and including a first data processor adapted for receiving and processing data and a transmitter adapted for transmitting data to a receiver at the remote location regarding the movements and/or activities of the subject;

said first data processor including a memory for storing an identification of the electronic monitoring device and a program for operating the first data processor; and a manual resetting device for resetting the electronic monitoring device, said manual resetting device including:

a second data processor storing the program to be downloaded into the memory of the first data processor;

an "Enable" key adapted for enabling the electronic monitoring device and adapted for downloading said program to the electronic monitoring device;

a "Disable" key adapted for disabling the electronic monitoring device; and an indicator adapted for indicating whether the electronic monitoring device has been successfully reset.

13. The electronic monitoring system according to claim 12, wherein said manual resetting device further includes an identification number stored in the second data processor, and wherein said second data processor is programmed to download said identification number into the memory of the first data processor when resetting the electronic monitoring device.

14. The electronic monitoring system according to claim 12, wherein said second data processor is programmed when downloading the program into the memory of the first data processor to command the electronic monitoring device to periodically transmit the identification number with other data to the receiver at said remote location.

15. The electronic monitoring system according to claim 14 wherein said second data processor is programmed when downloading the program into the memory of the first data processor to store the identification of the electronic monitoring device and the program downloaded to the electronic monitoring device.

16. The electronic monitoring system according to claim 12, wherein said electronic monitoring device includes a closure member having two parts disposed on opposite sides of straps adapted for securing the electronic monitoring device to the subject according to the size of the subject; one of said closure member parts and one of said straps include corresponding electrical terminals which are connected together when the one closure member is applied to the one strap.

* * * * *